US007764904B2

(12) United States Patent
Kim et al.

(10) Patent No.: US 7,764,904 B2
(45) Date of Patent: Jul. 27, 2010

(54) IMAGE FORMING APPARATUS WITH CONDUCTIVE MEMBER AND DEVELOPING DEVICE THEREOF

(75) Inventors: Jong In Kim, Suwon-si (KR); Myoung Su Baek, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 287 days.

(21) Appl. No.: 11/941,273

(22) Filed: Nov. 16, 2007

(65) Prior Publication Data

US 2008/0205946 A1 Aug. 28, 2008

(30) Foreign Application Priority Data

Feb. 23, 2007 (KR) ..... 10-2007-0018525

(51) Int. Cl.
*G03G 15/04* (2006.01)
*G03G 15/00* (2006.01)

(52) U.S. Cl. ..... 399/119; 399/390

(58) Field of Classification Search ..... 399/119, 399/303, 388, 390

See application file for complete search history.

(56) References Cited

U.S. PATENT DOCUMENTS 6,741,832 B2 5/2004 Tomatsu
2002/0044798 A1 * 4/2002 Katsumi et al. ..... 399/297

* cited by examiner

*Primary Examiner*—David M Gray
*Assistant Examiner*—Gregory H Curran
(74) *Attorney, Agent, or Firm*—Stanzione & Kim, LLP

(57) ABSTRACT

An image forming apparatus having the improved construction and mounting structure of a device for charging paper to be attached to a paper feed body is disclosed. The image forming apparatus includes a plurality of developing devices and a paper feed body which is mounted opposite to the plurality of developing devices and rotates to feed paper. A sheet member is mounted to a developing device of the plurality of developing devices, which is disposed on an uppermost paper stream side in a feeding direction of the paper. The sheet member charges the paper as it advances to the paper feed body to attach the paper to the paper feed body. The image forming apparatus further includes a voltage transmission part which transmits high voltage to the sheet member. The voltage transmission part includes a conductive fixing member to which an end of the sheet member is fixed, and a voltage transmission plate having a first end portion with a terminal contact portion to contact a terminal mounted in a main body and a second end portion electrically connected to the fixing member.

27 Claims, 6 Drawing Sheets

IMAGE FORMING APPARATUS WITH CONDUCTIVE MEMBER AND DEVELOPING DEVICE THEREOF

CROSS-REFERENCE TO RELATED APPLICATIONS

This application claims the benefit under 35 U.S.C. 119 (a) of Korean Patent Application No. 2007-0018525, filed on Feb. 23, 2007 in the Korean Intellectual Property Office, the disclosure of which is incorporated in its entirety.

BACKGROUND OF THE INVENTION

1. Field of the Invention

The present general inventive concept relates to an image forming apparatus, and more particularly to an image forming apparatus in which paper is fed while being attached to a paper feed body.

2. Description of the Related Art

An image forming apparatus is an apparatus that prints an image on a printing medium, e.g., paper, according to an inputted image signal. One example of the image forming apparatus is an electrophotographic image forming apparatus. The electrophotographic image forming apparatus is configured such that a light beam is scanned across a photosensitive body charged with a predetermined electric potential to form an electrostatic latent image on the outer peripheral surface of the photosensitive body. The electrostatic latent image is developed into a visible image by supplying a toner to the electrostatic latent image, and the visible image is transferred and fixed onto paper. An electrophotographic color image forming apparatus is configured such that toners of different colors are supplied to respective photosensitive bodies to form images of different colors, and the images of different colors are overlapped and transferred onto paper to achieve a color image.

FIG. 1 is a view illustrating a conventional color image forming apparatus. As illustrated in FIG. 1, the conventional image forming apparatus includes four developing devices 1Y, 1M, 1C, and 1K, in which toners of different colors, e.g., yellow (Y), magenta (M), cyan (C), and black (K), are respectively contained, a paper feed belt 3 which rotates while contacting photosensitive bodies 2Y, 2M, 2C and 2K provided respectively in the developing devices 1Y, 1M, 1C, and 1K, and a paper attaching roller 4 which attaches a printing medium, e.g., paper P to the paper feed belt 3.

When the paper is fed between the paper attaching roller 4 and the paper feed belt 3, a high voltage is applied to the paper attaching roller 4. Accordingly, the paper is attached to the paper feed belt 3 by an electrostatic force, and is fed at the same velocity as a traveling velocity of the paper feed belt 3.

The developing devices 1Y, 1M, 1C, and 1K develop electrostatic latent images formed on the respective photosensitive bodies 2Y, 2M, 2C, and 2K into yellow, magenta, cyan, and black toner images according to color image information transmitted to the image forming apparatus. The yellow, magenta, cyan and black toner images are then overlapped and transferred onto the paper in sequence, thereby achieving a color toner image on the paper.

The external housings of the developing devices 1Y, 1M, 1C, and 1K are designed such that spaces SY, SM, SC, and SK are formed between each of the housings of the developing devices 1Y, 1M, 1C, and 1K and the paper feed belt 3 to install the paper attaching roller 4 therein. However, the paper attaching roller 4 is only installed in one of the spaces SY, SM, SC, and SK formed among the developing devices, and thus the remaining unused spaces are superfluous. For instance, the space SY, which is formed between the paper feed belt 3 and the developing device 1Y and disposed on the uppermost paper stream side in a feeding direction of the paper, is a useful space in which the paper attaching roller 4 is installed. But, the spaces SM, SC, and SK, which are formed between the paper feed belt 3 and the other developing devices 1M, 1C and 1K, create an unnecessary waste of space.

In order to solve the above problem, two solutions have been implemented to alter the design of the external housings of the developing devices. With the first solution, the external housings of the developing devices were designed so that only the developing device 1Y on the uppermost stream side includes the space for installing the paper attaching roller 4. Alternatively, with the second solution, the external housings of the developing devices 1Y, 1M, 1C, and 1K were designed without the spaces being formed between each of the respective developing devices 1Y, 1M, 1C, and 1K and the paper feed belt 3. Thus, the paper attaching roller 4 is installed below the developing device 1Y. However, the first solution has a shortcoming of the components being incompatible due to the different shape of the developing device 1Y as compared to the other developing devices 1M, 1C, and 1K. The second solution has a shortcoming of an increase in size of the image forming apparatus due to an increase in the height of the set of developing devices by the size of the paper attaching roller 4.

As illustrated in FIG. 1, the paper attaching roller 4 of the conventional image forming apparatus is pressed toward the paper feed belt 3 by the elastic force of a spring (not shown). If the force exerted to press the paper attaching roller 4 is greater than a predetermined reference value, when the front end of the paper P advances to the paper attaching roller 4 or the rear end of the paper leaves from the paper attaching roller 4, the feeding speed of the paper P cannot be maintained at a constant speed as it is guided along the paper feed belt 3 due to the excessive pressing force. The inconsistent feeding speed of the paper causes deterioration of image quality, e.g., color discordance. On the other hand, if the force of pressing the paper attaching roller 4 is less than the predetermined reference value, the paper attaching roller 4 may easily separate or dislodge from the image forming apparatus as a result of any external jolts or shock to the image forming apparatus.

Further, as the image forming apparatus is used over a long period of time, paper dust or residual toner particles accumulate inside of the image forming apparatus during the developing process. Thus, another drawback of the conventional image forming apparatus is that the outer peripheral surface of the paper attaching roller 4 is easily contaminated with dust from the paper P dust or toner particles.

SUMMARY OF THE INVENTION

Accordingly, the present general inventive concept provides an image forming apparatus and a developing device that can efficiently utilize an inner space of the apparatus by improving the construction and the mounting structure of a device to charge paper.

The present general inventive concept also provides an image forming apparatus and a developing device thereof that prevents deterioration of image quality due to an excessive pressure exerted on paper during the paper charge function.

The present general inventive concept also provides an image forming apparatus and a developing device thereof that protects a device that charges a sheet of paper P from being contaminated with ambient foreign substances.

Additional aspects and/or utilities of the general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus including a plurality of developing devices and a paper feed body which is mounted opposite to the plurality of developing devices and rotates to feed paper, the paper feed body including a sheet member which is mounted to or in the vicinity of a developing device of the plurality of developing devices, which is disposed on an uppermost paper stream side in a feeding direction of the paper, and charges the paper as it advances to the paper feed body to attach the paper to the paper feed body.

The image forming apparatus may further include a fixing member which is fixed to a lower portion of the developing device disposed on the uppermost paper stream side. A first end of the sheet member may contact the paper as it advances to the paper feed body in a width direction, and a second end of the sheet member may be adhered to the fixing member.

The sheet member may be adhered to the fixing member by a conductive adhesive member.

The image forming apparatus may further include a voltage transmission plate, of which a first end portion is provided with a terminal contact portion to contact a terminal to apply voltage to the developing device disposed on the uppermost paper stream side, and a second end portion extending toward the sheet member to transmit voltage to the sheet member.

The second end portion of the voltage transmission plate may be formed with a voltage transmission protrusion, and the fixing member may include a protrusion contact portion which contacts the voltage transmission protrusion.

The image forming apparatus may further comprise a side frame which is mounted to a side portion of the developing device disposed on the uppermost paper stream side. The voltage transmission plate may be mounted to the side frame.

The sheet member may be provided with a hole, through which foreign substances on the sheet member may drop. A foreign substance container may be mounted below the sheet member to collect the foreign substances that drop through the hole.

The foregoing and/or other aspects and utilities of the present general inventive concept may also be achieved by providing an image forming apparatus including a main body, a paper feed body which is mounted inside the main body and rotates to feed paper, a sheet member to contact the paper feed body at a first end and to charge the paper to attach the paper to the paper feed body, and a voltage transmission part to transmit voltage to the sheet member.

The image forming apparatus may further include a plurality of developing devices to develop an image on the paper that is fed while being attached to the paper feed body. The sheet member may be mounted to a developing device of the plurality of developing devices, which may be disposed on an uppermost paper stream side in a feeding direction of the paper.

The voltage transmission part may include a conductive fixing member to which a second end of the sheet member is fixed, and a voltage transmission plate of which a first end portion is provided with a terminal contact portion to contact a terminal mounted in the main body and a second end portion being electrically connected to the fixing member.

The voltage transmission part may further include a conductive adhesive member to adhere the sheet member to the fixing member.

The second end portion of the voltage transmission plate may be formed with a protrusion, and the fixing member may be provided with a protrusion contact portion which contacts the protrusion.

The foregoing and/or other aspects and utilities of the present general inventive concept may also be achieved by providing a developing device of an image forming apparatus, which develops an image on paper attached to a paper feed body that rotates, including a developing device frame, a conductive sheet member which is supported by the developing device frame and has a first end contacting the paper feed body, and at least one voltage transmission member which transmits voltage applied to the developing device to the sheet member.

The voltage transmission member may include a conductive fixing member which is mounted to a lower portion of the developing device frame, and the sheet member may have a second end which is electrically connected to the fixing member.

The voltage transmission member may further include a conductive adhesive member which is provided between the sheet member and the fixing member.

The developing device may further comprise a side frame which is mounted to a side portion of the developing device frame. The voltage transmission member may further include a voltage transmission plate which is mounted to the side frame and has an end electrically connected to the fixing member.

The foregoing and/or other aspects and utilities of the present general inventive concept may also be achieved by providing a developing device of an image forming apparatus to develop an image on a printing medium including a chargeable sheet member disposed at a lower surface thereof to electrically charge the printing medium as the printing medium contacts the sheet member.

The sheet member may include an opening to release printing particles that accumulate on the sheet member.

The developing device may also include a voltage transmission member to supply a voltage to charge the sheet member.

The image forming apparatus may also include a fixing member coupled to the sheet member by a conductive adhesive member and the sheet member may be coupled to the developing device by the fixing member.

BRIEF DESCRIPTION OF THE DRAWINGS

These and/or other aspects and utilities of the of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
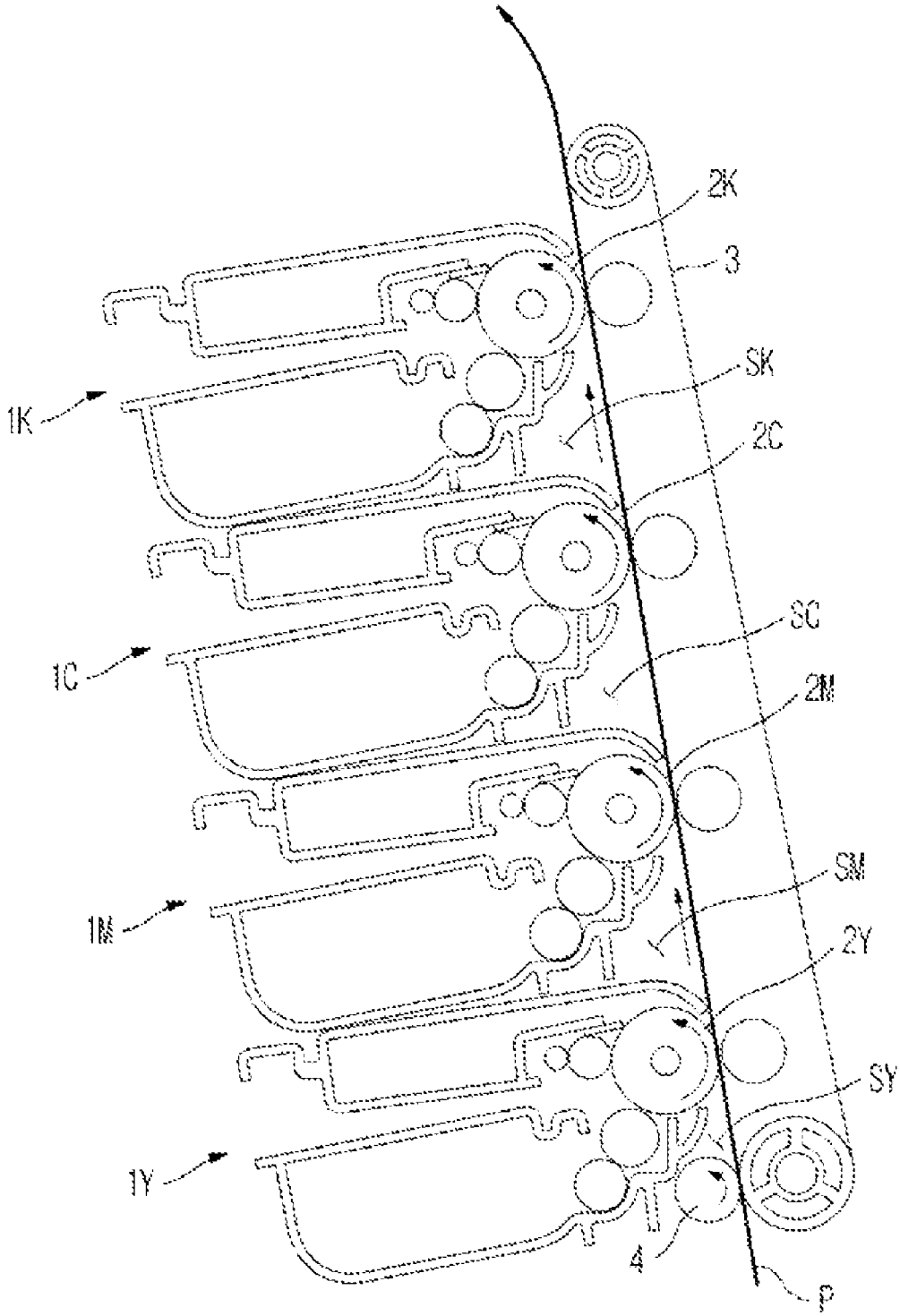
Fig. 1 (RELATED ART)
FIG. 1 is a view illustrating a conventional color image forming apparatus.

Reference will now be made in detail to embodiments of the present general inventive concept, examples of which are illustrated in the accompanying drawings, wherein like reference numerals refer to like elements throughout. The embodiments are described below to explain the present general inventive concept by referring to the figures.

Figure 2:
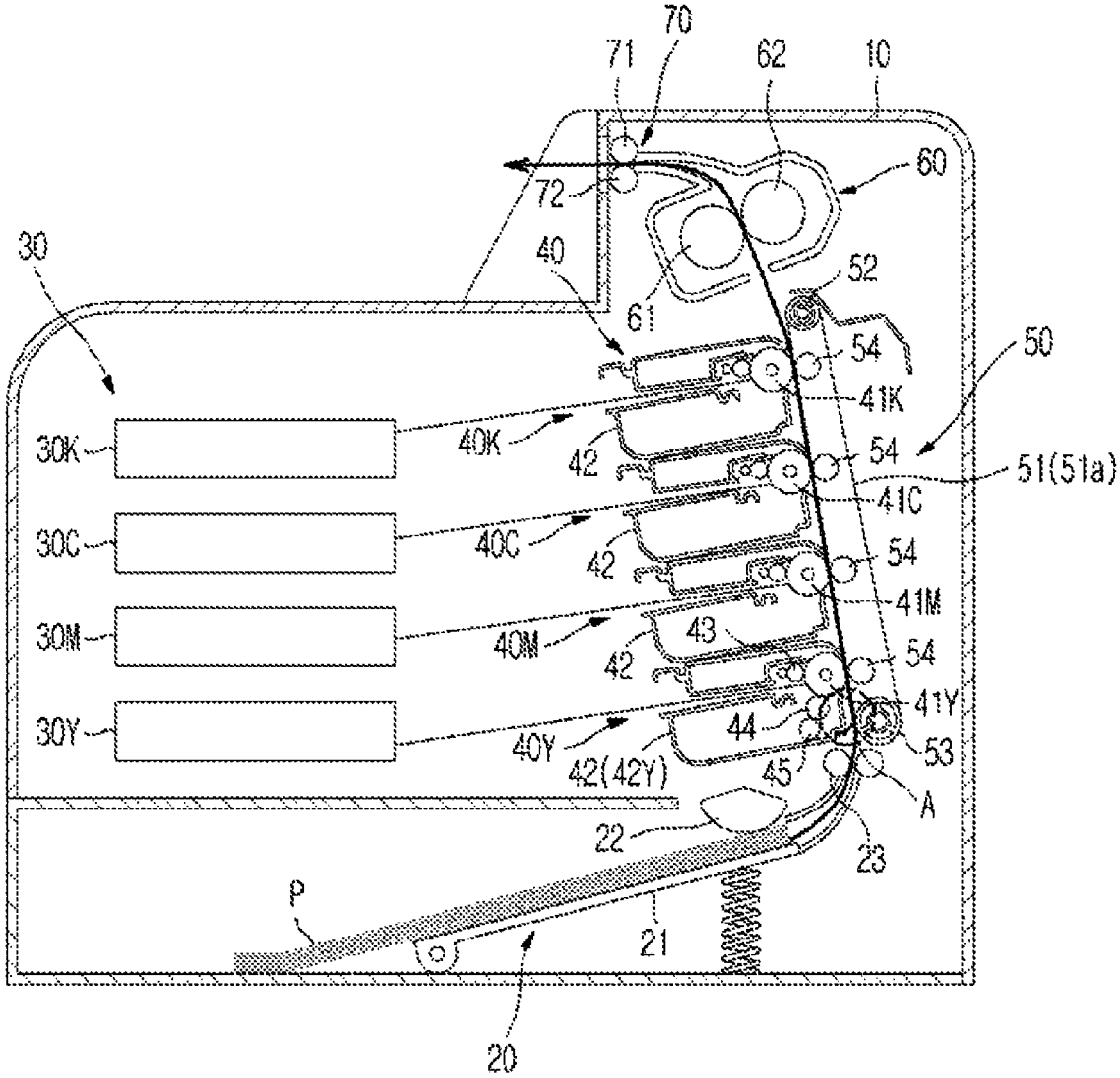
FIG. 2 is a sectional view illustrating an image forming apparatus in accordance with an embodiment of the present general inventive concept.

FIG. 2 is a sectional view illustrating the image forming apparatus in accordance with an embodiment of the present general inventive concept.

As illustrated in FIG. 2, the image forming apparatus according to the present embodiment includes a main body 10, which forms an external housing and supports components installed inside the image forming apparatus, a paper supply unit 20, an exposure unit 30, a development unit 40, a transfer unit 50, a fixing unit 60, and a paper discharge unit 70.

The paper supply unit 20 supplies a printing medium, e.g., paper P, to the image forming apparatus. The paper supply unit 20 includes a paper tray 21 on which the paper P is loaded, and a pickup roller 22 which picks up the paper P loaded on the paper tray 21 sheet by sheet. The paper P picked up by the pickup roller 22 is fed to the development unit 40 by a feed roller 23.

The development unit 40 includes four developing devices 40Y, 40M, 40C, and 40K, in which toners of different colors, e.g., yellow (Y), magenta (M), cyan (C), and black (K), are respectively contained. The developing devices 40Y, 40M, 40C, and 40K are respectively provided with photosensitive bodies 41Y, 41M, 41C, and 41K on which an electrostatic latent image is formed by the exposure unit 30. The exposure units 30Y, 30M, 30C and 30K irradiate light corresponding to image information including the colors of yellow (Y), magenta (M), cyan (C), and black (K), respectively, to the photosensitive bodies 41Y, 41M, 41C, and 41K of the respective developing devices according to a print signal that is transmitted to the image forming apparatus.

Each of the developing devices 40Y, 40M, 40C, and 40K include a development frame 42 which surrounds and supports components installed inside the developing devices 40Y, 40M, 40C, and 40K. Each development frame 42 accommodates a charge roller 43 to charge each of the photosensitive bodies 41Y, 41M, 41C, and 41K, a developing roller 44 to develop the electrostatic latent image formed on each of the photosensitive bodies 41Y, 41M, 41C, and 41K into a visible image, and a supply roller 45 to supply the toner to the developing roller 44.

The transfer unit 50 transfers the toner image developed on the photosensitive bodies onto the paper P. In particular, the transfer unit 50 includes a paper feed body 51 which is disposed opposite to the developing devices 40Y, 40M, 40C, and 40K and transfers the paper P past the photosensitive bodies 41Y, 41M, 41C, and 41K in sequence. The paper P supplied from the paper supply unit 20 is attached to the paper feed body 51, and is fed at the same speed as a traveling speed of the paper feed body 51. In the above description, the paper feed body 51 according to the present general inventive concept is configured as a paper feed belt 51*a*, however, the present general inventive concept is not restricted thereto. Thus, any type of feed member that is capable of transferring the paper P along a surface of the feed member can be supplied with the paper feed body 51.

The transfer unit 50 includes a driving roller 52 which drives the paper feed belt 51*a*, a tension roller 53 which maintains a constant tensile force of the paper feed belt 51*a*, and four transfer rollers 54 which transfer the toner image developed on the photosensitive bodies 41Y, 41M, 41C, and 41K onto the paper. The four transfer rollers 54 are disposed opposite to the respective photosensitive bodies 41Y, 41M, 41C, and 41K while interposing the paper feed belt 51*a* therebetween.

Figure 3:
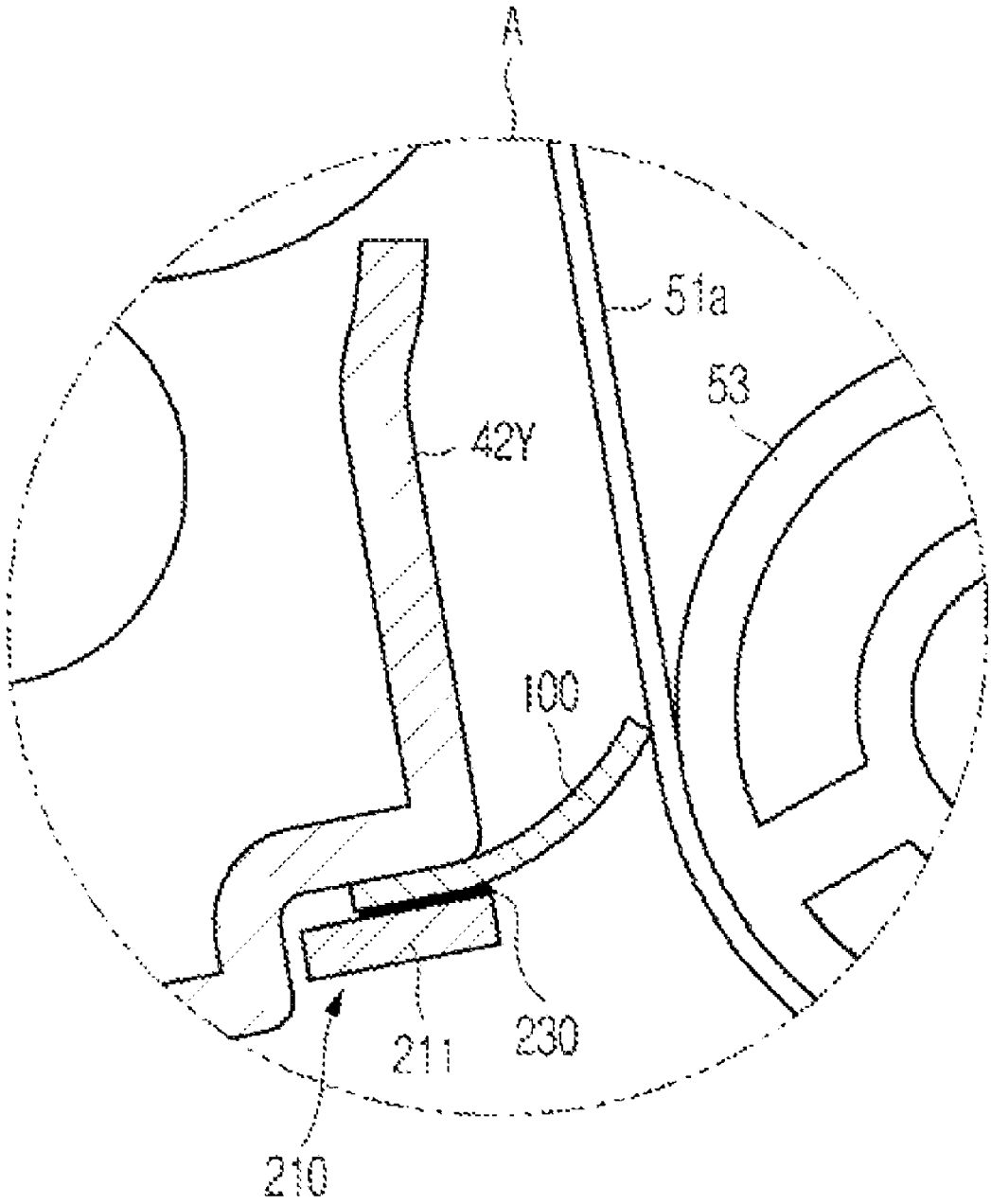
FIG. 3 is an enlarged view of an "A" portion of the image forming apparatus as illustrated in FIG. 2.
Figure 4:
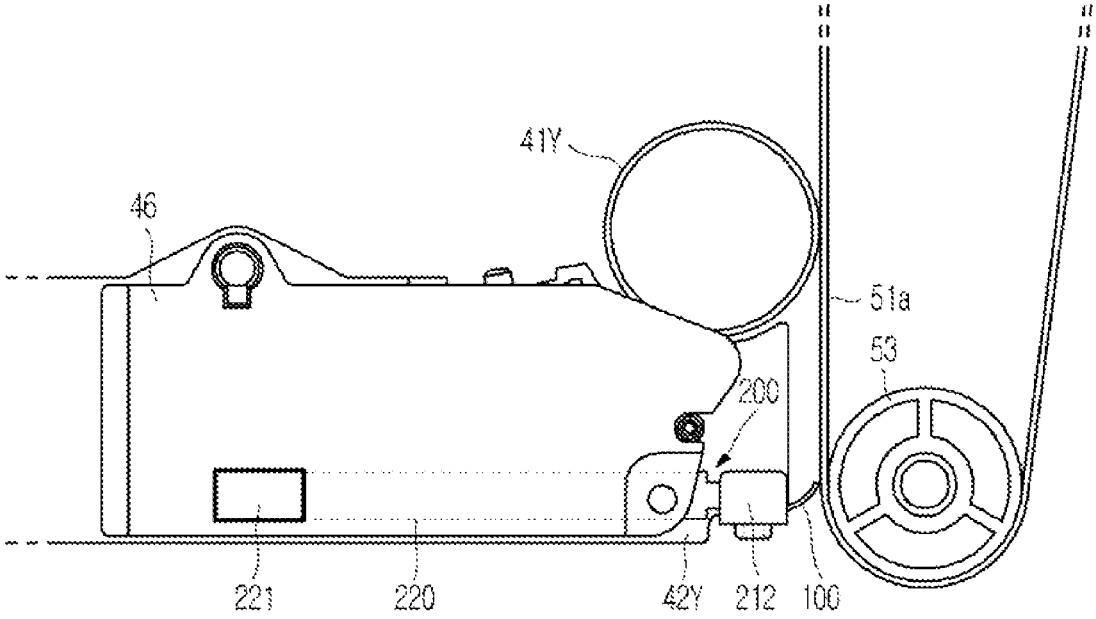
FIG. 4 is a side view illustrating the image forming apparatus in accordance with another embodiment of the present general inventive concept.
Figure 5:
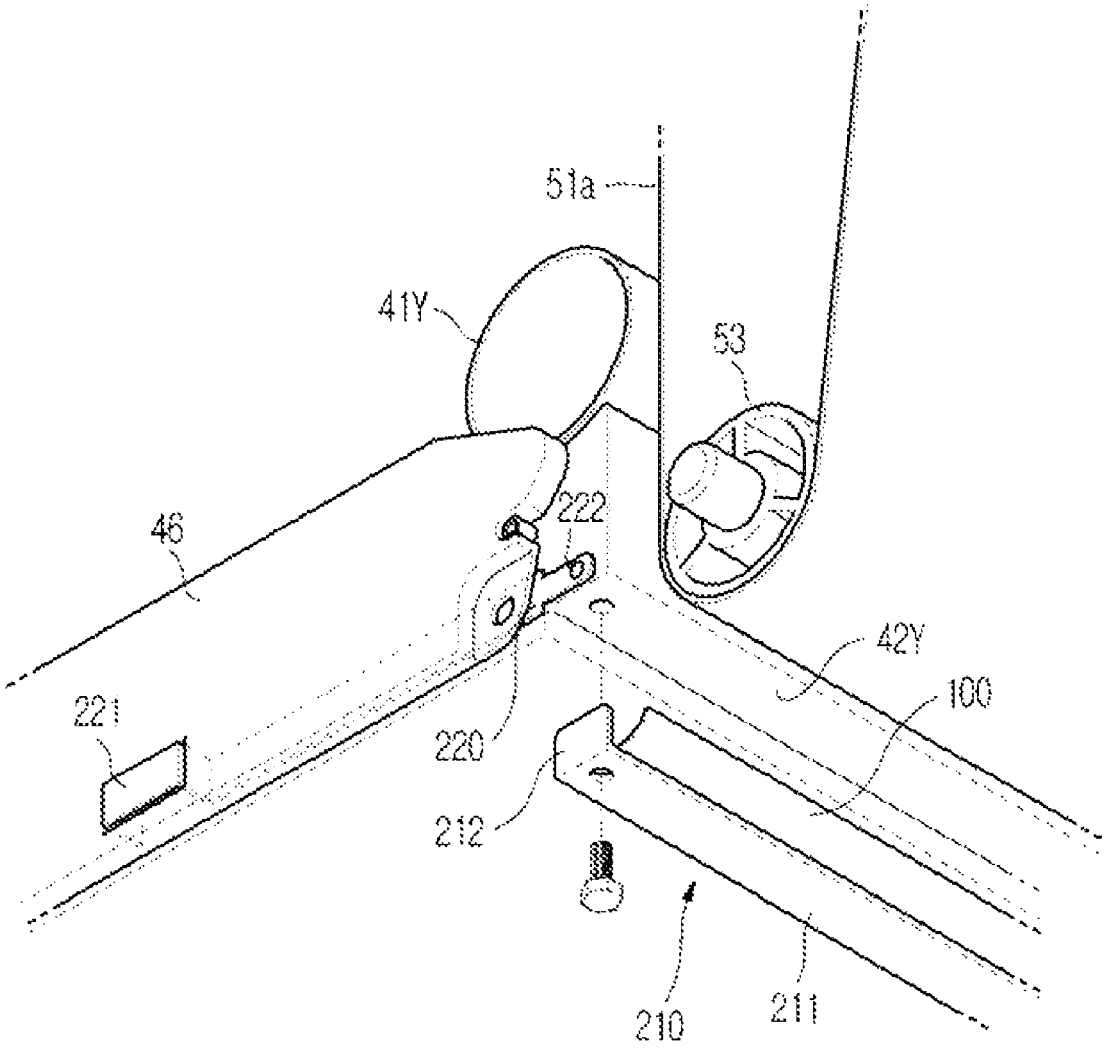
FIG. 5 is a perspective view illustrating a fixing member and a sheet member illustrated in FIG. 4.

FIG. 3 is an enlarged view of a section of the image forming apparatus of FIG. 2 according to an embodiment of the present general inventive concept illustrating the space between development frame 42Y and tension roller 53, which is referenced as section "A". FIG. 4 is a side view illustrating the image forming apparatus in accordance with an embodiment of the image forming apparatus of FIG. 2. FIG. 5 is a view illustrating a fixing member and a sheet member as illustrated in FIG. 4.

As illustrated in FIGS. 2 to 5, the image forming apparatus of the present embodiment includes a conductive sheet member 100 having one end in contact with the paper feed belt 51*a*, in a width direction, to charge the paper P as it advances along the paper feed belt 51*a*, and a voltage transmission part 200 to transmit the voltage required for the sheet member 100 to charge the paper.

In particular, when the voltage is transmitted through the voltage transmission part 200 and applied to the sheet member 100, the paper P is fed from the paper supply unit 20 and advances between the sheet member 100 along the paper feed belt 51*a*. During this process, the paper P is also electrically charged, and thus attaches to the paper feed belt 51*a* by an electrostatic force.

The sheet member 100 is mounted to the developing device 40Y, which is disposed on an uppermost paper stream side in a feeding direction of the paper. The sheet member 100 may alternatively be mounted in the vicinity of the developing device 40Y. The end of the sheet member 100 is in continuous contact with the paper feed belt 51*a* due to a constant pressure exerted by the force of the sheet member 100. The sheet member 100 is positioned opposite to the tension roller 53 while interposing the paper feed belt 51*a* therebetween.

Since the sheet member 100 can be installed in a relatively narrow space, the sheet member 100 is more effective with regard to minimizing the amount of space utilized, as compared to the conventional structure described above which uses a roller to charge the paper P. Also, with regard to the conventional structure, if any portion of an outer surface of the roller is contaminated with foreign substances, the paper charge function will be negatively affected. However, according to the present general inventive concept, as long as the end of the sheet member 100 that contacts the paper P is not contaminated, although other portions of the sheet member 100 may be contaminated, the paper charge performance is not affected. Further, since the sheet member 100 is either mounted to or in the vicinity of the developing device 40Y in the present general inventive concept, whenever replacing the developing device 40Y, the sheet member 100 may also be replaced with a new sheet member 100. Thus, deterioration of the paper charge performance due to fatigue and/or contamination of the sheet member 100 will be prevented.

The sheet member 100 may be made of a conductive polymer material, such as polyacetylene, polyaniline, polypyrrole, polythiophene, poly sulfur nitride, conductive polyethylene terephthalate, etc. In certain embodiments according to the present general inventive concept, the sheet member 100 may have a thickness of 0.2 mm or less. Additionally, a nip pressure of the sheet member 100, which is applied to the paper P when pressing the paper to the paper feed belt 51*a*, is set to 14.76 gf/10 mm or less.

As illustrated in FIGS. 4 and 5, the voltage transmission part 200, which transmits voltage to the sheet member 100, includes a series of voltage transmission members, i.e., a conductive fixing member 210 that is electrically connected to the sheet member 100 and a voltage transmission plate 220 that is electrically connected to the fixing member 210.

The voltage transmission plate 220 is fitted in a side frame 46 and mounted to a side portion of the developing device frame 42Y. A first end portion 220*a* of the voltage transmission plate 220 is provided with a terminal contact portion 221 which is exposed to an outside of the side frame 46. A second end portion 220*b* of the voltage transmission plate 220 extends toward the sheet member 100. The terminal contact portion 221 contacts a terminal (not shown) provided in the main body 10 so as to apply voltage to the developing device 40Y and the sheet member 100. Taking into consideration the combined factors of stability and the paper attaching force of the sheet member 100 the voltage that is applied to the terminal contact portion 221 through the terminal (not shown) is set having a voltage ranging from 400 V to 600 V. Alternate voltage ranges may be applied to the terminal contact portion, thus the present general inventive concept is not limited thereto.

The second end portion 220*b* of the voltage transmission plate 220 is provided with a voltage transmission protrusion 222 which protrudes sideward and outwardly from the voltage transmission plate. The protrusion 222 connects the fixing member 210 to the voltage transmission plate 220.

The fixing member 210 is fixed to the bottom of the developing device frame 42Y by using a coupling member such as a screw. The fixing member 210 includes a base plate 211 which extends in the width direction of the developing device frame 42Y and has an end of the sheet member 100 attached thereto and a protrusion contact portion 212 which is bent upward from an end of the base plate 211. When attaching the fixing member 210 to the developing device frame 42Y, the inner surface of the protrusion contact portion 212 elastically contacts the protrusion 222 of the voltage transmission plate 220.

As illustrated in FIG. 3, the sheet member 100 may alternatively be adhered to the base plate 211 of the fixing member 210 by using a conductive adhesive member 230. Any conductive double-sided adhesive tape can be used as the adhesive member 230.

As illustrated in FIG. 2, the fixing unit 60 fixes the image onto the paper P by applying heat and pressure to the paper. The fixing unit 60 includes a heat roller 61 which has a heat source to heat the toner-transferred paper P, and a press roller 62 which is disposed opposite to the heat roller 61 and maintains a constant fixing pressure with the heat roller 61. In other words, the heat roller 61 and the press roller 62 of the fixing unit 60, simultaneously supply heat and constant pressure to fix the toner images onto the paper P.

The paper discharge unit 70 includes a discharge roller 71 which discharges the paper P after having passed through the fixing unit 60 to the outside of the main body 10, and a discharge backup roller 72 which is disposed opposite to the discharge roller 71.

Hereinafter, the operation of the image forming apparatus according to the present general inventive concept will be described with reference to FIGS. 2 to 5. If a print command is input and transmitted to the image forming apparatus, the respective photosensitive bodies 41Y, 41M, 41C, and 41K are charged with a regular electric potential by the charge roller 43, and the respective exposure units 30Y, 30M, 30C, and 30K irradiate light corresponding to image information of yellow, magenta, cyan, and black to the respective photosensitive bodies 41Y, 41M, 41C, and 41K according to a print signal generated by the image forming apparatus. According to the color image information transmitted, electrostatic latent images are formed on the surfaces of the respective photosensitive bodies 41Y, 41M, 41C, and 41K. The developing rollers 44 of the developing devices 40Y, 40M, 40C, and 40K develop the electrostatic latent images into visible images having the colors of yellow, magenta, cyan, and black by supplying the toner to the electrostatic latent images.

The paper P loaded on the paper tray 21 is picked up by the pickup roller 22, and is fed to the paper feed belt 51*a*. At this time, a voltage is applied to the terminal contact portion 221 of the voltage transmission plate 220 from the main body 10, and the applied voltage is transmitted to the sheet member 100 via the voltage transmission plate 220 and the fixing member 210. The paper P that advances between the sheet member 100 and the paper feed belt 51*a* is charged by the voltage applied to the sheet member 100, and accordingly the paper P is attached to the paper feed belt 51*a* by an electrostatic force and fed along the paper feed belt 51*a* at the same velocity as the traveling velocity of the paper feed belt 51*a*. When the paper P fed by the paper feed belt 51*a* passes between the respective photosensitive bodies 41Y, 41M, 41C and 41K and the transfer rollers 54, the visible images of yellow, magenta, cyan and black which are developed on the photosensitive bodies 41Y, 41M, 41C and 41K are overlapped and transferred onto the paper P to achieve a color image that corresponds to the transmitted print image information. The images transferred onto the paper P are then fixed to the paper P while passing through the fixing unit 60, and the paper P having passed the fixing unit 60 is discharged to the outside of the main body 10 by the discharge roller 71.

Figure 6:
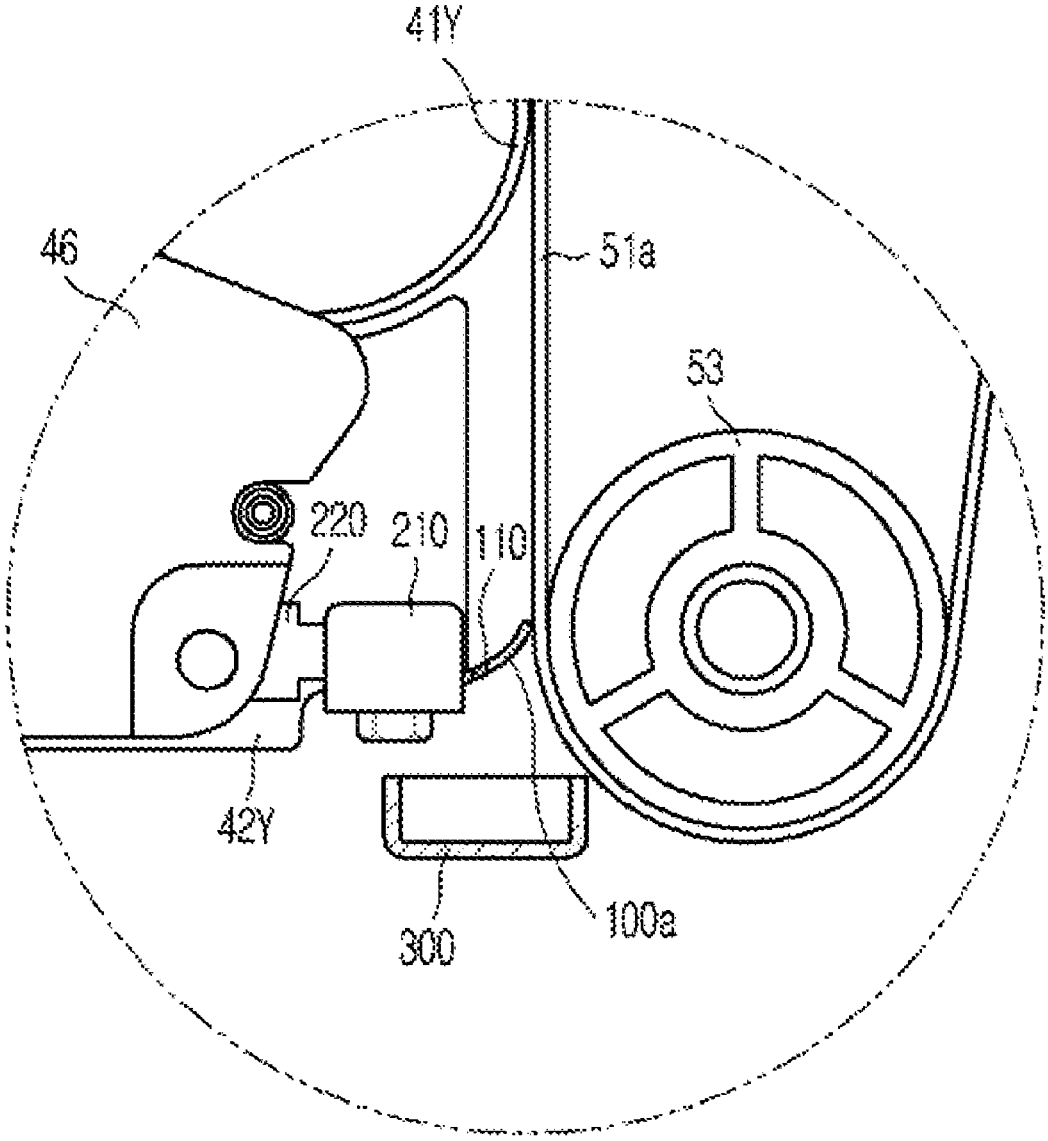
FIG. 6 is a sectional view of the image forming apparatus in accordance with the embodiment as illustrated in FIG. 2.

FIG. 6 is an enlarged sectional view illustrating a section of the image forming apparatus of FIG. 2 in accordance with another embodiment of the present general inventive concept. The characteristics of this embodiment will be described hereinafter, and the same components as the embodiment illustrated in FIG. 4 are denoted by the same reference numerals. For convenience in the illustration, the sheet member and a foreign substance container are magnified and illustrated in FIG. 6.

Paper dust or toner particles scattered during the developing process exist inside the image forming apparatus. Such foreign substances accumulate on the sheet member 100*a* when a large amount of voltage is applied to the sheet member 100*a*. The accumulation of foreign substances could potentially be catastrophic and may cause deformation or breakage of the sheet member 100*a*. Alternatively, when foreign substances accumulate on the sheet member 100, the sheet member 100 exerts extra pressure on the paper P as the paper P comes in contact with the sheet member 100*a* and is pressed toward the paper feed belt 51*a*. The extra pressure exerted is greater than a predetermined reference value, and as a result, the paper P is susceptible to high resistance when passing by the sheet member 100*a*, thereby causing deterioration of image quality, e.g., color discordance.

In the present embodiment, the sheet member 100*a* is formed with a hole 110, through which the foreign substances on the sheet member 100*a* may drop.

When providing the sheet member 100*a* with the hole 110, it is preferable to install a foreign substance container 300 below the sheet member 100*a* so as to collect the foreign substances dropping through the hole 110 and store therein.

As is apparent from the above description, the image forming apparatus according to the embodiments of the present general inventive concept can efficiently utilize space within the main body because the sheet member 100*a* according to the present general inventive concept provides a simple structure and does not occupy a large amount of space.

Further, since the sheet members of the various embodiments of the present general inventive concept are securely supported by the developing device, the sheet members are not easily separated by external shock or movements applied to the image forming apparatus, and also can press paper with a proper pressure, thereby preventing deterioration of image quality due to the excessive pressure.

Further, the sheet members of the various embodiments of the present general inventive concept have structural features such that the sheet member will not be negatively affected by foreign substances as compared to utilizing a conventional roller. Additionally, since the sheet member may be mounted to the developing device, whenever replacing the developing device, the sheet member may also be replaced by a new one, thereby continuously ensuring the stability of the paper charging function.

Although a few embodiments of the present general inventive concept have been illustrated and described, it would be appreciated by those skilled in the art that changes may be made in these embodiments without departing from the principles and spirit of the general inventive concept, the scope of which is defined in the claims and their equivalents.

What is claimed is:

1. An image forming apparatus including a plurality of developing devices and a paper feed body which is mounted opposite to the plurality of developing devices and rotates to feed paper, comprising:

a sheet member mounted to or in the vicinity of a developing device of the plurality of developing devices and supported by the frame of the developing device, the sheet member being disposed on an uppermost paper stream side in a feeding direction of the paper, and charges the paper as it advances to the paper feed body to attach the paper to the paper feed body.

2. The image forming apparatus according to claim 1, further comprising:

a fixing member fixed to a lower portion of the developing device that is disposed on the uppermost paper stream side, wherein a first end of the sheet member contacts the paper as it advances to the paper feed body in a width direction, and a second end of the sheet member is adhered to the fixing member.

3. The image forming apparatus according to claim 2, wherein the sheet member is adhered to the fixing member by a conductive adhesive member.

4. The image forming apparatus according to claim 1, further comprising:

a voltage transmission plate, having a first end portion with a terminal contact portion to contact a terminal to apply voltage to the developing device disposed on the uppermost paper stream side, and a second end portion extending toward the sheet member to transmit the voltage to the sheet member.

5. The image forming apparatus according to claim 4, further comprising:

a conductive fixing member fixed to the developing device disposed on the uppermost stream paper side to support the sheet member, wherein the second end portion of the voltage transmission plate is formed with a voltage transmission protrusion, and the fixing member is provided with a protrusion contact portion to contact the voltage transmission protrusion.

6. The image forming apparatus according to claim 4, further comprising:

a side frame which is mounted to a side portion of the developing device disposed on the uppermost paper stream side, wherein the voltage transmission plate is mounted to the side frame.

7. The image forming apparatus according to claim 1, wherein the sheet member is provided with a hole, through which foreign substances on the sheet member drop.

8. The image forming apparatus according to claim 7, further comprising:

a foreign substance container mounted below the sheet member to collect the foreign substances that drop through the hole.

9. The image forming apparatus according to claim 1, wherein the sheet member includes a conductive material.

10. The image forming apparatus according to claim 1, wherein the sheet member has a thickness of 0.2 mm or less.

11. An image forming apparatus comprising:

a main body;

a paper feed body mounted inside the main body and to rotate to feed paper;

a sheet member to contact the paper feed body at a first end and to charge the paper as it advances to the paper feed body to attach the paper to the paper feed body and to be supported by a developing device frame; and a voltage transmission part to transmit voltage to the sheet member.

12. The image forming apparatus according to claim 11, further comprising:

a plurality of developing devices to develop an image on the paper fed while being attached to the paper feed body, wherein the sheet member is mounted to a developing device of the plurality of developing devices, which is disposed on an uppermost paper stream side in a feeding direction of the paper.

13. The image forming apparatus according to claim 11, wherein the voltage transmission part includes a conductive fixing member to which a second end of the sheet member is fixed, and a voltage transmission plate having a first end portion with a terminal contact portion to contact a terminal mounted in the main body and a second end portion is electrically connected to the fixing member.

14. The image forming apparatus according to claim 13, wherein the voltage transmission part further includes a conductive adhesive member to adhere the sheet member to the fixing member.

15. The image forming apparatus according to claim 13, wherein the second end portion of the voltage transmission plate is formed with a protrusion, and the fixing member is provided with a protrusion contact portion to contact the protrusion.

16. A developing device of an image forming apparatus to develop an image on paper attached to a paper feed body that rotates, the developing device comprising:

a developing device frame;

a conductive sheet member supported by the developing device frame and having a first end to contact the paper feed body; and at least one voltage transmission member to transmit voltage applied to the developing device to the sheet member.

17. The developing device according to claim 16, wherein the voltage transmission member includes a conductive fixing member which is mounted to a lower portion of the developing device frame, and the sheet member has a second end being electrically connected to the fixing member.

18. The developing device according to claim 17, wherein the voltage transmission member further includes a conductive adhesive member provided between the sheet member and the fixing member.

19. The developing device according to claim 17, further comprising:

a side frame mounted to a side portion of the developing device frame, wherein the voltage transmission member further includes a voltage transmission plate mounted to the side frame and has an end electrically connected to the fixing member.

20. The developing device according to claim 16, wherein the sheet member is provided with a hole, through which foreign substances on the sheet member drop.

21. The developing device according to claim 16, wherein the sheet member includes a conductive polymer material, having a thickness of 0.2 mm or less.

22. A developing device of an image forming apparatus to develop an image on a printing medium, the developing device comprising:

a chargeable sheet member disposed at a lower surface thereof to electrically charge the printing medium as the printing medium contacts the sheet member and supported by the frame of the developing device.

23. The developing device of claim 22, wherein the sheet member includes an opening to release printing particles that accumulate on the sheet member.

24. The developing device of claim 22, further comprising:

a voltage transmission member to supply a voltage to charge the sheet member.

25. The developing device of 24, further comprising:

a fixing member being coupled to the sheet member via a conductive adhesive member, wherein the sheet member is coupled to the developing device frame by the fixing member.

26. An image forming apparatus comprising:

at least one developing device to apply toner to a print medium;

a voltage transmission part attached to the at least one developing device;

a transfer unit to transfer a toner image developed on the at least one developing device onto the print medium; and a conductive sheet member positioned between the transfer unit and the voltage transmission part to charge the print medium as it advances along a feed direction of the print medium, and supported by the frame of the developing device.

27. The image forming apparatus of claim 26, wherein the sheet member further comprises of a curved and flexible polymer material.

* * * * *